US005145172A

United States Patent [19]

Takashima

[11] Patent Number: 5,145,172

[45] Date of Patent: Sep. 8, 1992

[54] STRING FOR RACKET

[75] Inventor: Yutaka Takashima, Hyogo, Japan

[73] Assignee: Gosen Co., Ltd., Osaka, Japan

[21] Appl. No.: 347,646

[22] Filed: May 5, 1989

[51] Int. Cl.[5] ..... A63B 51/02

[52] U.S. Cl. ..... 273/73 R

[58] Field of Search ..... 273/73 R

[56] References Cited

U.S. PATENT DOCUMENTS 4,377,620 3/1983 Alexander ..... 273/73 R

FOREIGN PATENT DOCUMENTS 108375 of 1980 Japan .
56-9496 3/1980 Japan .
101165 of 1984 Japan ..... 273/73 R
1225340 of 1986 Japan ..... 273/73 R
2167094 of 1986 United Kingdom ..... 273/73 R

*Primary Examiner*—William H. Grieb
*Assistant Examiner*—Raleigh W. Chiu
*Attorney, Agent, or Firm*—Armstrong, Nikaido, Marmelstein, Kubovcik & Murray

[57] ABSTRACT

The invention deals with a string for use in rackets used for tennis and badminton and so on. These are wound around the periphery of a monofilament center core in a mixed condition, wrapping monofilaments of a large diameter and a small diameter and the wrapping monofilaments are covered with a coating resin such that a part in a periphery side of the large diameter wrapping monofilament is uncovered. Moreover, the elongation of the wrapping monofilaments of large diameter and small diameter is greater by 5–40% than the elongation of monofilament center core. This string is superior in ball control and has a higher knot strength.

4 Claims, 1 Drawing Sheet

STRING FOR RACKET

BACKGROUND OF THE INVENTION

The present invention refers to a string for rackets and, in detail, to a string for rackets used for sports such as tennis, badminton, and squash, etc., for which a synthetic resin fiber is used as a material.

It is known to produce a string by winding monofilaments made of synthetic resin about the periphery of a monofilament center core, also made of a synthetic resin. This type of a string, composed of a monofilament center core and a wrapping monofilament, can be improved in its important properties by choosing particular combinations of materials for the monofilament center core and the wrapping monofilament.

The properties required for a string for rackets comprise durability and repulsive force coupled with the ability to easily impart a spin or a slice to an object being struck. Also, to increase its commercial value, its external appearance should be beautiful.

Special features of the strings made by wrapping monofilament around a monofilament center core include the ability to produce a thick string, which is hard to do with a monofilament center core only, to be able to easily change the outer diameter of the string by selection of the outer diameter of the wrapping monofilament, to enhance such mechanical strength as durability, etc., to have the ability to control the imparting of a spin or slice to an object being struck because friction resistance between the string and the ball being hit increases with formation of unevenness on the peripheral surface of the composite due to the wrapping monofilament.

It has been sought to improve the above-described control property. Further, in a case where the string is strung on a racket, it has been found that, when hitting a ball, the filament is apt to snap due to rubbing between warp and weft strings at their crossing points. Improvement in strings to alleviate this problem is also desired. However, since the known wrapping monofilaments have been uniformly prepared from monofilament of the same outer diameter, improvement in the control property is very limited and prevention of rubbing between warp and weft strips is not sufficiently possible.

Thus, a string was proposed in which the monofilament center core had wrapped therearound mixed monofilaments of a small diameter and a large diameter, respectively. This string causes a part of the wrapping monofilament having a large diameter to project away from the core filament further than the diametrical projection of the small diameter wrapping filament, so that there are alternatively formed a generally convex area corresponding to the projected part of the large diameter wrapping monofilament and a generally concave area corresponding to the diametrical surface portions of the small diameter wrapping monofilament. If this string is strung on a racket, rubbing can be prevented at the above-described crossing point of the warp and the weft strings by contacting a raised (convex) portion of one string with a depressed (concave) portion of the crossing string. Also, this unevenness, due to the convex and concave areas, gives greater friction when a ball is hit, so as to more easily impart a spin or a slice.

However, a string for rackets prepared by winding a wrapping monofilament around the periphery of a monofilament center core is less than satisfactory in that its knot strength is small in comparison with its tensile strength.

The tensile strength is determined by a weight breaking a string when being drawn straight and the knot strength is determined by a weight breaking a string when both the terminal ends of a knot formed in the string are drawn apart. Ordinarily, the string breaks at the knot or knotted part when the string is employed for rackets. That is, when a string is strung on a racket frame lengthwise and crosswise, the knot strength is a better measure of the practical strength of the string than is the previously described tensile strength of the string.

In a string constructed of a wrapping monofilament around the periphery of a monofilament center core, when its knotted part is stressed, the wrapping monofilament is stretched more on its peripheral side than is the monofilament center core. Therefore, when the elongation is of the same order of magnitude for both the core monofilament and the wrapping monofilament, even if the core monofilament is not stretched so far that it still has sufficient strength to resist breaking, the wrapping monofilament having been stretched to a greater extent, does break. Normally, the wrapping monofilament is thin in comparison with the core monofilament and lower in the knot strength. Therefore, the knot strength of the whole composite string is limited by the knot strength of the wrapping monofilament.

On the other hand, in recent years the coloring and fashion-making for sport equipment, such as tennis rackets and so on, are in rapid progress, and regarding rackets, the design and color of racket frames, etc., have been widely varied. However, the strings for rackets have, in most cases, so far been simply transparent or of simple coloring and not satisfactory in terms of beauty and fashion.

OBJECT OF THE INVENTION

The first purpose of this invention comprises a string for rackets comprising a wrapping monofilament wound around the periphery of a core monofilament, which has higher strength and durability with enhanced knot strength. Another purpose is to raise the commercial value of such a strung racket by enhancing the beauty of the string thereof.

SUMMARY OF THE INVENTION

The inventor undertook research to attain the purposes of this invention, and completed this invention by finding that, if there is used a wrapping monofilament having a higher elongation to break than the monofilament center core, the wrapping monofilament alone cannot be broken before the breaking of the monofilament center core and, therefore, an increase in the knot strength of the whole of the string is attained.

The string for rackets of this invention comprises a winding of mixed wrapping monofilaments, of a small diameter and a larger diameter, around a periphery of a core monofilament, wherein a part in a peripheral side of the large diameter wrapping monofilament is exposed, only the small diameter wrapping monofilament is covered by a coating resin, and the elongation of the previously-described wrapping monofilaments of large diameter and small diameter is 5–40% greater than elongation of the center core monofilament.

Materials suitable for use as the monofilament center core, the small diameter wrapping monofilament, and the large diameter wrapping monofilament include various kinds of synthetic resin monofilaments and synthetic fibers. Since the peripheral side of the large diameter wrapping monofilament is exposed together with the resin coated on the peripheral surface of the small diameter wrapping monofilament, and color and brilliance of the large diameter wrapping filament can be selected to contrast with the coating resin. If the large diameter wrapping monofilament is transparent, the color of the monofilament center core can be seen therethrough, and then the color of monofilament center core should be considered for visual effect. Likewise, if the coating resin is transparent, the color of the small diameter wrapping monofilament would need to be considered.

All the monofilaments used should be proper insofar as their physical properties as the materials for the strings for rackets are concerned and also, in particular, the elongation of both the wrapping monofilaments used should be greater, by 5–40%, than that of the core monofilament. The elongation of monofilaments can be adjusted by adjusting the nature of the synthetic resins themselves, which are the materials used for making the monofilaments, as well as by adjusting the various manufacture methods, such as stretching, etc., during or after spinning.

According to this invention, when a weight is loaded at the knotted ends of a string, both of the wrapping monofilaments can be stretched to up to 5–40% increased elongation over that of the core monofilament. If both the wrapping monofilaments can be sufficiently stretched, the wrapping monofilaments will not be broken before breaking of the core monofilament and, therefore, the core monofilament and both the wrapping monofilaments bear the knot strength in cooperation, so that the knot strength of whole of the composite string is enhanced.

By comparing the color and brilliance of the resin being used for coating the small diameter wrapping monofilament with those of the large diameter wrapping monofilament, a string for rackets can be provided with a previously unknown specialty and thus with superior fashion. For example, if the large diameter wrapping monofilament is transparent and the coating resin is opaque, the transparent wrapping monofilament shows a pattern, which is projected into the opaque coating resin on the periphery of a string and thus, a very pretty appearance is obtained.

DETAILED DESCRIPTION OF THE INVENTION

The string for rackets of the present invention is illustrated below in detail referring to the figures.

Figure 1:
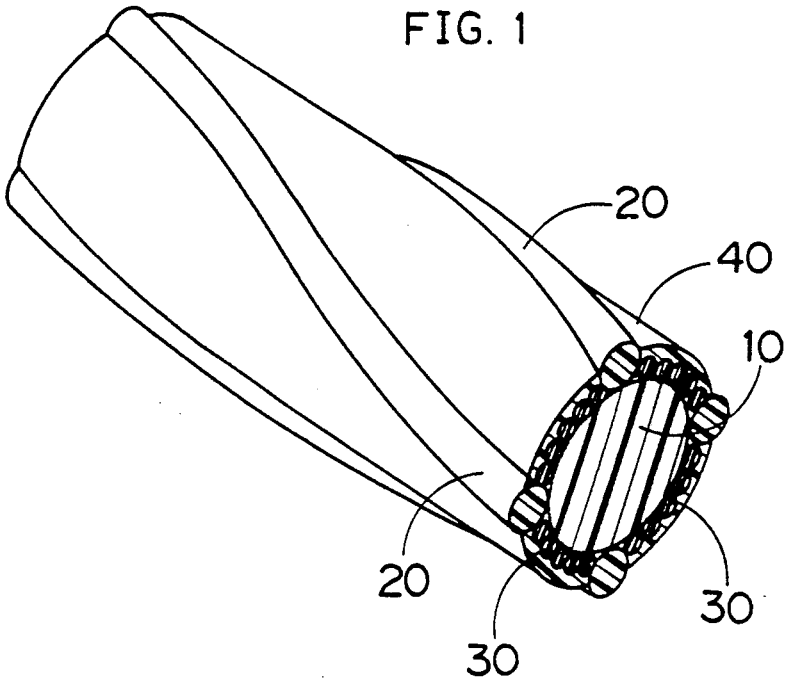
FIG. 1 is a section perspective view of a string for rackets according to the present invention.
Figure 2:
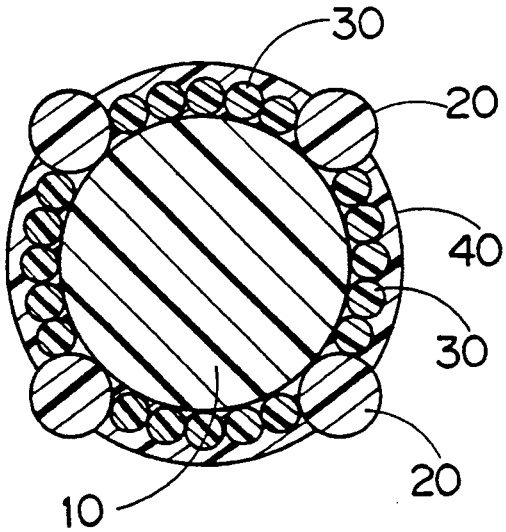
FIG. 2 is an enlarged section view of one embodiment of a string for rackets according to the present invention.

As shown in FIG. 1 and FIG. 2, the present string is composed of a monofilament center core 10, a wrapping monofilament of a large diameter 20 and a wrapping monofilament of a small diameter 30 wound around the periphery of the monofilament center core 10 and, in addition, a coating resin 40 covers the periphery of the small diameter wrapping monofilament 30.

Although Nylon 6, Nylon 66, and copolymers thereof are suitably employed as the materials of choice for all of the monofilament center core 10 and both the wrapping monofilaments 20 and 30, other kinds of synthetic resin monofilaments, synthetic fibers, or filaments can be employed. The characteristic properties, like color, transparency, brilliance, and so on, of each of the monofilaments 10, 20, and 30 can be arbitrarily decided by design. Regarding the external diameter of the monofilament center core, a range of about 0.40–1.10 mm is suitable for use. The external diameter of the large diameter wrapping monofilament 20 is suitably in a range of about 0.15–0.30 mm, and the external diameter of the small diameter wrapping monofilament 30 is in a range of about 0.10–0.20 mm. Strengths of the monofilament center core 10 and both the wrapping monofilaments 20 and 30, regarding tensile strength and knot strength and so on, are in a range usually used for a string for rackets. Additionally, the elongation to break of both the wrapping monofilaments 20 and 30 should be about 5–40% greater than that of the monofilament center core. The elongation of monofilaments is expressed as the percentage of the increase in length at the moment of breaking against the string length at rest. The elongation of monofilaments can be adjusted by selection of materials for the synthetic resin of which the monofilament is composed, or by stretching the monofilament while it is being spun.

Figure 3:
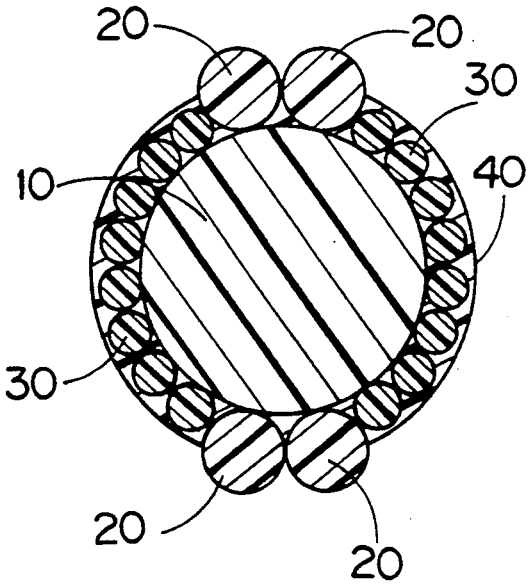
FIG. 3 is an enlarged section view to show another structure which is exemplary of a string for rackets according to this invention.

Although the number of large diameter wrapping monofilaments 20 and small diameter wrapping monofilaments 30 is variable depending on the outer diameters of the core monofilament 10 and each of the wrapping monofilaments 20 and 30, it is usual for several pieces of small wrapping monofilaments 30 to be used as well as one or only a few pieces of large diameter wrapping monofilaments 20. Arrangement of the large diameter wrapping monofilaments 20 and the small diameter wrapping monofilaments 30 is accomplished by substantially equidistantly spacing the large diameter wrapping monofilaments 20 about the core monofilament, and interposing the small diameter monofilaments 30 therebetween. Alternatively, the large diameter wrapping monofilaments 20 may be paired as shown in FIG. 3. For instance, in the examples of FIG. 1 and FIG. 2, four pieces of the large diameter wrapping monofilaments 20 and twenty pieces of the small diameter wrapping monofilaments 30 were combined, with each piece of the large diameter wrapping monofilaments 20 being arranged at an interval of 90 degrees around the periphery of the core monofilament 10. The spaces between each piece of the large diameter wrapping monofilament 20 are, respectively, filled with five pieces of the small diameter wrapping monofilaments 30. In the example shown in FIG. 3, two pieces each of the large diameter wrapping monofilaments 20 are arranged at the two diametrically opposed positions about the core monofilament 10 and the space between these are filled with sixteen pieces of the small wrapping monofilaments 30.

Both the wrapping monofilaments 20 and 30 can be wound around the monofilament center core 10 in a similar manner to the ordinary method of manufacturing ordinary strings for rackets. Both the wrapping monofilaments 20 and 30 are spirally wound around the monofilament center core 10 under the condition that both the wrapping monofilaments 20 and 30 are arranged in parallel. Adhesives may be used to firmly fix the monofilament center core 10 and both the wrapping monofilaments 20 and 30 to each other, respectively.

While both the wrapping monofilaments 20 and 30 are wound around the monofilament center core 10, a layer of a suitable coating resin 40 is provided covering only the periphery of the small diameter wrapping monofilament 30. The materials for the coating resin 40 should have a good joining ability for all the filaments 10, 20, and 30, such as a Nylon resin and the like. The coating resin 40 may be a transparent a resin or an opaque resin containing such inorganic materials as titanium dioxide and the like, or an organic pigment.

Where the coating resin 40 is opaque, thereby causing the small diameter wrapping monofilaments 30 to not be seen, the color of the small diameter wrapping monofilaments 30 need not be considered. Color and brilliance of the coating resin are determined by considering its contrast to the large diameter wrapping monofilament 20 to get a better appearance of the whole body of string. Where the coating resin 40 is transparent or semitransparent, such as by using a colored transparent resin which has a degree of light permeability, the small diameter wrapping monofilament 30 can be seen through the coating resin 40, so that there is obtained special beauty effects different from the case where the small diameter wrapping monofilament 30 is fully exposed or fully hidden. In this case, the color of the small diameter wrapping monofilament 30, which is seen externally, needs to be considered because of its contrast to the large diameter wrapping monofilament 20. Although the small diameter wrapping monofilament 30 is completely covered by the coating resin 40, a part of the peripheral side of the large diameter wrapping monofilament 20 is arranged to be seen outside the coating resin 40. As the exposed parts of the large diameter wrapping monofilament 20 increase in size, the friction resistance increases with respect to a ball being hit, and the wearability of strings is enhanced. Further, the large diameter wrapping monofilament 20 becomes conspicuous in its outer appearance.

The small diameter wrapping monofilament 30 is coated with the resin 40 by applying the coating resin 40 in a melted state after both the wrapping monofilaments 20 and 30 have been wound around the monofilament center core 10 and, by adjusting the coating amount of the resin so as to coat only the small diameter wrapping monofilaments 30. Also, conventional means of coating a resin onto ordinary synthetic resin filaments can be adopted. For an example, a method of soaking the composite string comprising a monofilament center core 10 which is overwound with both the wrapping monofilaments 20 and 30, in a solution of the coating resin 40 followed by pulling the string up, and the like has been used.

When the coating resin 40 is colored by means of, for instance, dyeing with dyestuffs or the like, after the small diameter wrapping monofilament 20 has been coated with the coating resin 40, the appearance of the coating resin 40 turned out to have characteristic beauty.

The coating resin 40 has, in addition to its function of hiding the appearance of and a coating function, for the small diameter wrapping monofilament 30, the function of an adhesive to assist joining both the wrapping monofilaments 20 and 30 to themselves and each other. Also, the coating resin 40 increases other properties, such as strength and repulsive force, of the whole of the composite string. To display these functions nicely, a material suitable to display all the functions is used as the material of coating resin 40.

EXAMPLES

The following examples of the present invention will illustrate an actual manufacture of strings for rackets and determination of their characteristic properties.

As the monofilament center core is used a monofilament composed of Nylon 6 of a diameter of 0.87 mm, a tensile strength of 55.4 kg, a knot strength of 28.8 kg, and an elongation of 25.5% with light permeability. As the large diameter wrapping monofilament is used a monofilament composed of Nylon 6 of a diameter of 0.28 mm, a tensile strength of 5.52 kg, a knot strength of 5.25 kg, ar elongation of 37.2%, with light permeability. As the small diameter wrapping monofilament is used a mono filament composed of Nylon 6 of a diameter 0.16 mm, a tensile strength of 1.95 kg, a knot strength of 1.79 kg, and an elongation of 38.5% with light permeability.

Four pieces of the large diameter wrapping monofilament and thirteen pieces of the small diameter wrapping monofilament were wound around the periphery of the above-described monofilament center core. Arrangement of the wrapping monofilament is as shown in FIG. 3 wherein two pieces respectively of the large diameter wrapping monofilament are arranged at diametrically opposed positions about the periphery of the monofilament center core and the small diameter wrapping monofilament is arranged at the remaining positions about the periphery of the monofilament center core. All the wrapping monofilaments are spirally wound in order. The wrapping monofilaments are adhesively bonded to the monofilament center core and to each other. As a result, the greatest diameter of the wrapped strip was 1.43 mm.

Melted Nylon containing 2.0% titanium dioxide was extruded from a nozzle onto the periphery of the monofilament center core wound with the previously-described wrapping monofilaments under such conditions that a part of the peripheral side of the large diameter wrapping monofilament was exposed, to obtain a string partially covered by an opaque coating resin.

The string obtained was of beautiful design such that the large diameter transparent wrapping monofilament spirally projected through the opaque coating resin. The largest diameter of the string was 1.366 mm. On measurement of the physical properties of the string, its tensile strength was 82.1 kg, knot strength was 56.5 kg, and elongation was 32.0%. These values were sufficient for use as a string for rackets. In particular, the knot strength was a far larger value, compared to the value of 40–50 kg for a string composed of only the monofilament made of synthetic resin by a previously known ordinary means, so that improvement in the strength for use and the durability were in fact proved.

This string was actually put up on an ordinary tennis racket and offered to a trial hitting. The results showed that it was very easy to impose a spin or a slice on a hit ball. Thus, this material was very useful as a string for rackets.

I claim:

1. In a string for rackets comprising a winding of mixed wrapping monofilaments, of a large diameter and a small diameter, around the periphery of a monofilament center core, the improvement which comprises said large diameter monofilament being substantially transparent, the exposed surface of said small diameter wrapping monofilament and a portion of the exposed surface of said large diameter wrapping filament being covered with a coating resin whereby a part of the large diameter wrapping filament is exposed, and wherein said wrapping filaments have an elongation to break which is greater than the elongation to break of said monofilament center core.

2. A string for rackets as claimed in claim 1 wherein both the wrapping monofilaments of large diameter and small diameter are spirally wound around the periphery of the monofilament center core.

3. A string for rackets as claimed in claim 1 wherein the monofilament center core, the large diameter wrapping monofilaments, and the small diameter wrapping monofilaments are composed of Nylon 6, Nylon 66, or copolymers thereof.

4. A string for rackets as claimed in claim 1 wherein said coating resin is substantially opaque.

* * * * *